US008952603B2

(12) United States Patent
Kobayashi

(10) Patent No.: US 8,952,603 B2
(45) Date of Patent: Feb. 10, 2015

(54) SPARK PLUG HAVING SPECIFIC GASKET STRUCTURE AND ORIENTATION

(71) Applicant: NGK Spark Plug Co., Ltd., Nagoya (JP)

(72) Inventor: Kenji Kobayashi, Gamagori (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 14/086,224

(22) Filed: Nov. 21, 2013

(65) Prior Publication Data

US 2014/0145583 A1 May 29, 2014

(30) Foreign Application Priority Data

Nov. 27, 2012 (JP) ..... 2012-258156

(51) Int. Cl.
*H01T 13/08* (2006.01)

(52) U.S. Cl.
CPC ..... *H01T 13/08* (2013.01)
USPC ..... 313/143; 313/141; 313/142

(58) Field of Classification Search
USPC ..... 313/141–145
See application file for complete search history.

(56) References Cited

U.S. PATENT DOCUMENTS

| | | | | |
|---|---|---|---|---|
| 2,941,105 | A * | 6/1960 | Rickenbach | 313/118 |
| 7,477,006 | B2 | 1/2009 | Fukuzawa et al. | |
| 7,914,353 | B2 * | 3/2011 | Kobayashi et al. | 445/7 |
| 2008/0098974 | A1 * | 5/2008 | Fukuzawa et al. | 123/169 R |
| 2008/0203882 | A1 * | 8/2008 | Kobayashi et al. | 313/141 |
| 2009/0102346 | A1 * | 4/2009 | Fukuzawa et al. | 313/135 |
| 2013/0098324 | A1 * | 4/2013 | Abe | 123/169 R |
| 2013/0147339 | A1 * | 6/2013 | Burrows | 313/143 |
| 2013/0169141 | A1 * | 7/2013 | Yoshizaki et al. | 313/141 |

FOREIGN PATENT DOCUMENTS

| | | | |
|---|---|---|---|
| JP | 2006-236906 | A | 9/2006 |
| JP | 2008-135370 | A | 6/2008 |

* cited by examiner

*Primary Examiner* — Mariceli Santiago
*Assistant Examiner* — Jacob R Stern
(74) *Attorney, Agent, or Firm* — Leason Ellis LLP.

(57) ABSTRACT

A spark plug includes a metal shell and a gasket. The metal shell includes a thread portion, a seat portion, and a thread root portion. The gasket has an inner diameter smaller than a thread size of the thread portion. The relationships $0.8L \leq C \leq L-2A$ and $B \leq 0.75L$ are satisfied in a case where: in the seat portion, an outer diameter of a seating portion is L (mm); the maximum value of a relatively shiftable distance is A (mm), the gasket is shiftable along a direction orthogonal to the axis relative to the metal shell by the maximum value; in the gasket, an outer diameter is C (mm); and in the gasket, an inner diameter is B (mm).

6 Claims, 6 Drawing Sheets

SPARK PLUG HAVING SPECIFIC GASKET STRUCTURE AND ORIENTATION

This application is based on Japanese Patent Application No. 2012-258156 filed with the Japan Patent Office on Nov. 27, 2012, the entire content of which is hereby incorporated by reference.

FIELD OF THE INVENTION

This disclosure relates to a spark plug for use in an internal combustion engine or the like.

BACKGROUND OF THE INVENTION

A spark plug is assembled to, for example, a combustion apparatus such as an internal combustion engine (an engine). In this case, the spark plug is used to ignite an air-fuel mixture in a combustion chamber. Generally, the spark plug includes an insulator having an axial hole, a center electrode, a tubular metal shell main body, and a ground electrode. The center electrode is inserted into the tip end side of the axial hole of the insulator. The metal shell main body is provided on the outer periphery of the insulator. The ground electrode is sealed to the tip end portion of the metal shell. A gap between the ground electrode and the center electrode is a spark discharge gap.

The metal shell includes a flange seat portion and a thread portion for mounting. The seat portion projects radially outward, of the metal shell. The thread portion is disposed on the tip end side with respect to the seat portion. The thread portion is used to install the metal shell on the combustion apparatus. A thread root portion is disposed between the seat portion and the thread portion. A solid annular gasket may be disposed at the thread root portion (for example, see JP-A-2008-135370). When the spark plug is mounted in the combustion apparatus, the gasket ensures air tightness between the spark plug (the metal shell) and the combustion apparatus.

The spark plug, for example, may be mounted in the combustion apparatus in such a way that the ground electrode is present between the fuel injection device and the spark discharge gap. In this case, the injected fuel contacts the back surface of the ground electrode. There is a consequent concern that supply of the air-fuel mixture to the spark discharge gap will be hindered by the ground electrode, adversely affecting the ignitability. Therefore, a method like the following is considered. Namely, a relative formation position of a thread ridge of the thread portion relative to a portion where the ground electrode is secured, which is at the tip end portion of the metal shell, is a position corresponding to, for example, where the tapping of an internal thread formed in a mounting hole of the combustion apparatus starts. Accordingly, when the spark plug is mounted in the combustion apparatus, the ground electrode is arranged in a predetermined position.

SUMMARY OF THE INVENTION

A spark plug includes a tubular metal shell extending along an axis, and a solid annular gasket disposed at an outer periphery of the metal shell. The metal shell includes: a thread portion for mounting formed at an outer periphery on a tip end side of the metal shell; a seat portion formed on a rear end side with respect to the thread portion, the seat portion bulging radially outward; and a thread root portion disposed between the thread portion and the seat portion. The gasket has an inner diameter smaller than a thread size of the thread portion, the gasket being disposed at an outer periphery of the thread root portion, and $0.8L \leq C \leq L-2A$ and $B \leq 0.75L$ are satisfied in a case where: in the seat portion, an outer diameter of a seating portion that is a surface positioned at the gasket side is L (mm); when the gasket contacts the seating portion, a maximum value of a relatively shiftable distance is A (mm), the gasket being shiftable along a direction orthogonal to the axis relative to the metal shell by the maximum value from a state where the axis and a central axis of the gasket coincide with each other; in the gasket, an outer diameter of a face in contact with the seating portion is C (mm); and in the gasket, an inner diameter of a face in contact with the seating portion is B (mm).

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
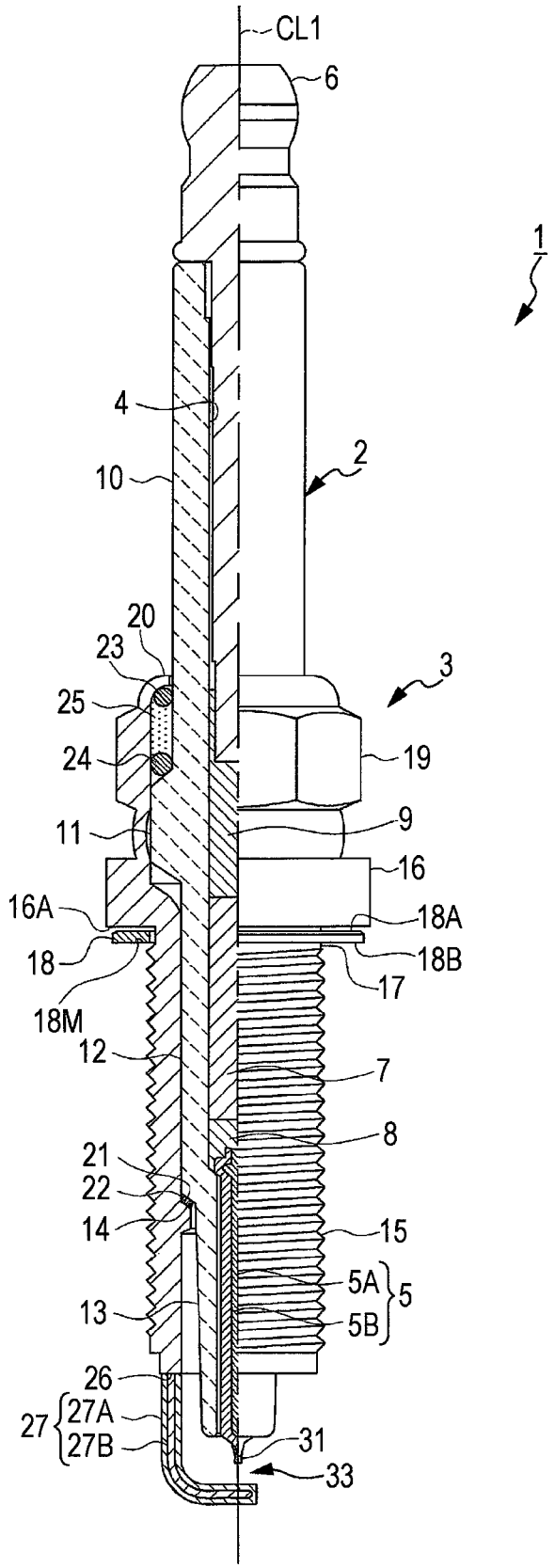
FIG. 1 is a partially sectioned front view showing the configuration of a spark plug.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Generally, a clearance is present between a thread root portion and an inner periphery of a gasket. In view of this, the gasket is shiftable along the radial direction. Accordingly, when a spark plug is mounted in a combustion apparatus, a contact area of a seat portion and the gasket may be fluctuated due to the shift of the gasket. In this case, a frictional contact resistance generated between both may be changed. As a result, even if a thread ridge of a thread portion is formed at a predetermined position relative to the tip end portion of the metal shell (a ground electrode) and the spark plug is mounted in the combustion apparatus with a predetermined tightening torque, the final arranged position of the ground electrode may be varied.

An object of this disclosure is to provide a spark plug where a ground electrode can be accurately disposed in a predetermined position by, for example, keeping a contact area of a seat portion and a gasket constant when the spark plug is mounted in a combustion apparatus.

Configurations suitable for achieving the above object will be described in itemized form. If needed, operational advantages peculiar to the configurations will be described additionally.

Configuration 1. A spark plug includes a tubular metal shell extending along an axis, and a solid annular gasket disposed at an outer periphery of the metal shell. The metal shell includes: a thread portion for mounting formed at an outer periphery on a tip end side of the metal shell; a seat portion formed on a rear end side with respect to the thread portion, the seat portion bulging radially outward; and a thread root portion disposed between the thread portion and the seat portion. The gasket has an inner diameter smaller than a thread size of the thread portion, the gasket being disposed at an outer periphery of the thread root portion, and $0.8L \leq C \leq L-2A$ and $B \leq 0.75L$ are satisfied in a case where: in the seat portion, an outer diameter of a seating portion that is a surface positioned at the gasket side is L (mm); when the gasket contacts the seating portion, a maximum value of a relatively shiftable distance is A (mm), the gasket being shiftable along a direction orthogonal to the axis relative to the metal shell by the maximum value from a state where the axis and a central axis of the gasket coincide with each other; in the gasket, an outer diameter of a face in contact with the seating portion is C (mm); and in the gasket, an inner diameter of a face in contact with the seating portion is B (mm).

According to the configuration 1, $C \leq L-2A$ is satisfied. In view of this, even if the gasket is most-shifted along the direction orthogonal to the axis, the face of the gasket in contact with a seating portion (a rear end side face) is positioned at an inner peripheral side with respect to the outermost peripheral portion of the seating portion. This allows reducing or preventing fluctuation in the contact area of the rear end side face of the gasket and the seating portion due to the shift of the gasket. That is, the contact area of the rear end side face of the gasket and the seating portion can be constant. This allows a frictional contact resistance generated between the rear end side face of the gasket and the seating portion constant when the spark plug is mounted in the combustion apparatus. As a result, when the spark plug is mounted in the combustion apparatus, the ground electrode can be accurately disposed in a predetermined position.

Generally, the larger an outer diameter C of the seating portion (corresponding to the thread size of the thread portion), the larger the tightening torque becomes when the spark plug is mounted in the combustion apparatus. As a result, a force applied from the seating portion to the rear end side face of the gasket becomes large. According to the configuration 1, $0.8L \leq C$ and $B \leq 0.75L$ are satisfied. That is, sufficient area along the rear end side face of the gasket is secured to correspond to the size of the outer diameter C of the seating portion (that is, to the amount of force applied to the rear end side face of the gasket). Accordingly, when the spark plug is mounted in the combustion apparatus, the application of excessively large pressure on the rear end side face of the gasket can be suppressed or prevented. Accordingly, the rear end side face of the gasket can be further reliably reduced or prevented from being excessively collapsed and deformed. This can suppress the thread portion to be excessively screwed in the combustion apparatus. Consequently, a variation in the turning angle of the spark plug can be further reliably suppressed or prevented. As a result, when the spark plug is mounted in the combustion apparatus, the ground electrode can be further accurately disposed in a predetermined position.

Since $0.8L \leq C$ and $B \leq 0.75L$ are satisfied, the contact area of the rear end side face of the gasket and the seating portion can be sufficiently ensured. As a result, good air tightness can be obtained.

Configuration 2. With the configuration 1, in the gasket, an outer diameter of a face at an opposite side from the seating portion is larger than an outer diameter of a face of the gasket in contact with the seating portion.

According to the configuration 2, the contact area of the face of the gasket at the opposite side from the seat portion (the tip end side face) and the combustion apparatus can be sufficiently ensured. As a result, further superior air tightness can be achieved.

According to the configuration 2, when the spark plug is mounted in the combustion apparatus, sliding the tip end side face of the gasket on the combustion apparatus can be efficiency reduced. This can reduce generating metal powder such as aluminum powder from the portion of the combustion apparatus in contact with the tip end side face of the gasket in accordance with the sliding of the gasket. As a result, stability of a frictional state can be ensured between the tip end side face of the gasket and the combustion apparatus. Accordingly, when the spark plug is mounted in the combustion apparatus, the ground electrode can be further accurately disposed in a predetermined position.

Configuration 3. With the configuration 1 or 2, the thread portion has a thread size equal to or less than M12.

Generally, the smaller the thread size of the thread portion is, the smaller the tightening torque becomes when the spark plug is mounted in the combustion apparatus. Here, in cases where the tightening torque is small, the location where the ground electrode is disposed is liable to vary due to fluctuation in a frictional contact resistance between the rear end side face of the gasket and the seating portion.

In this respect, according to the configuration 3, the thread size of the thread portion is equal to or less than M12. In view of this, variation in the location where the ground electrode is disposed is of greater concern. However, use of the configuration 1 or similar configuration can dispel the concern like this. In other words, the configuration 1 or similar configuration is especially meaningful for the spark plug with the thread portion with the thread size equal to or less than M12.

Configuration 4. With any one of the configurations 1 to 3, the thread portion has a thread size equal to or less than M10.

As the configuration 4, if the thread size of the thread portion is equal to or less than M10, a variation in the arranged position of the ground electrode is further concerned. However, use of the configuration 1 or similar configuration allows dispelling such concern. In other words, the configuration 1 or similar configuration is significantly meaningful for the spark plug with the thread portion with the thread size equal to or less than M10.

One embodiment will next be described with reference to the drawings. FIG. 1 is a partially sectioned front view showing a spark plug 1. Note that in the description of FIG. 1, a description will be given of a direction in which an axis CL1 of the spark plug 1 is a vertical direction in the drawing. Moreover, the lower side is the tip end side of the spark plug 1, and the upper side is the rear end side.

The spark plug 1 includes a tubular insulator 2 and a tubular metal shell 3, which holds the insulator 2 therein, etc.

The insulator 2 is formed from alumina or the like by sintering, as well known in the art. The insulator 2 externally includes a rear end trunk portion 10 formed on the rear end side, a large-diameter portion 11, an intermediate trunk portion 12, and an insulator nose length portion 13. The large-diameter portion 11 is located on the tip end side with respect to the rear end trunk portion 10 and formed to project radially outward. The intermediate trunk portion 12 is located on the tip end side with respect to the large-diameter portion 11 and is formed to be smaller in diameter than the large-diameter portion 11. The insulator nose length portion 13 is located on the tip end side with respect to the intermediate trunk portion 12 and is formed to be smaller in diameter than the intermediate trunk portion 12. The large-diameter portion 11, the intermediate trunk portion 12, and the greater portion of the insulator nose length portion 13 of the insulator 2 are accommodated within the metal shell 3. A shoulder portion 14 is formed at a connection portion between the intermediate trunk portion 12 and the insulator nose length portion 13 tapered off toward the tip end side. The insulator 2 is seated on the metal shell 3 along the shoulder portion 14.

Further, the insulator 2 has an axial hole 4 that extends along the axis CL1 and penetrates therethrough. A center electrode 5 is inserted into a tip end side of the axial hole 4. The center electrode 5 includes an inner layer 5A formed of metal excellent in thermal conductivity (for example, copper, copper alloy, and pure nickel (Ni)) and an outer layer 5B formed of an alloy that contains Ni as a main constituent. The center electrode 5 has a rodlike shape (a columnar shape) as a whole. The tip end portion of the center electrode 5 projects from the tip end of the insulator 2. A tip 31 including a metal excellent in wear resistance (for example, iridium alloy and platinum alloy) is provided at the tip end portion of the center electrode 5.

A terminal nut electrode 6 is fixedly inserted into a rear end side of the axial hole 4 and projects from the rear end of the insulator 2.

A columnar resistor 7 is disposed within the axial hole 4 between the center electrode 5 and the terminal nut electrode 6. Both end portions of the resistor 7 are electrically connected to the center electrode 5 and the terminal nut electrode 6, respectively, via electrically conductive glass seal layers 8 and 9.

The metal shell 3 is made of a low-carbon steel or a like metal. The metal shell 3 is formed into a tubular shape extending along the axis CL1. The metal shell 3 includes a thread portion (a male thread portion) 15 at the outer periphery on the tip end side. The thread portion 15 is used to mount the spark plug 1 into the mounting hole of the combustion apparatus (for example, an internal combustion engine or a fuel cell reformer). Also, the metal shell 3 includes a flange seat portion 16 located on the rear end side with respect to the thread portion 15. The seat portion 16 bulges radially outward. The cylindrically-shaped thread root portion 17 is disposed between the thread portion 15 and the seat portion 16. In this embodiment, to achieve the compact spark plug 1 (downsizing in diameter), the metal shell 3 is small in diameter. That is, the thread size of the thread portion 15 is equal to or less than M12 or equal to or less than M10.

Figure 2:
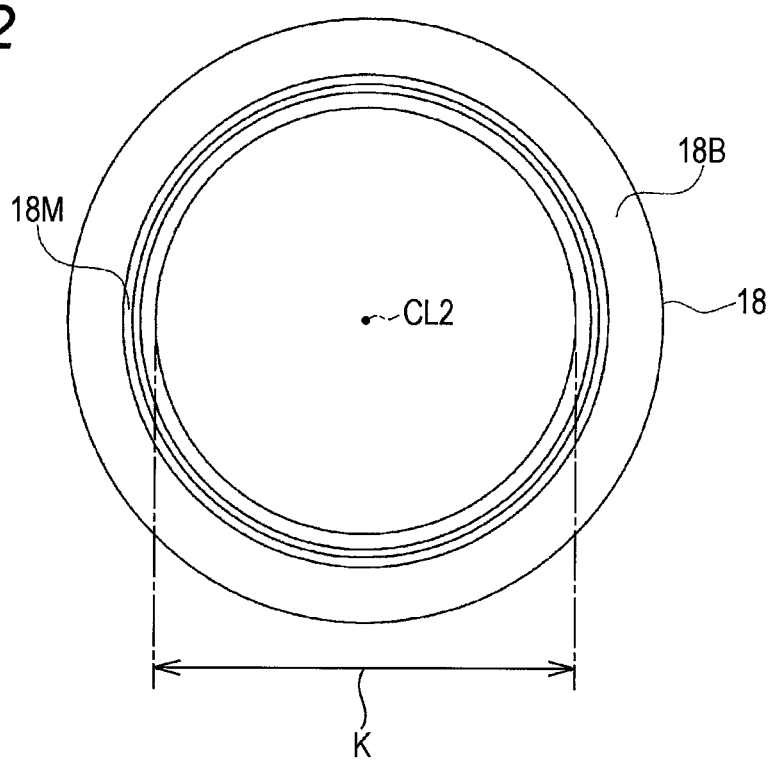
FIG. 2 is an enlarged bottom view showing the configuration of a tip end side face of a gasket.

A solid annular gasket 18 is engaged with the outer periphery of the thread root portion 17. The gasket 18 includes a predetermined metal (for example, a metal containing a copper or an iron as a main constituent). By screwing the thread portion 15 in the mounting hole, when the spark plug 1 is mounted in the combustion apparatus, a rear end side face 18A of the gasket 18 contacts a seating portion 16A of the seat portion 16. The seating portion 16A is a surface that faces the gasket 18 side. Then, a tip end side face 18B contacts the combustion apparatus. As shown in FIG. 2, the tip end side face 18B includes an annular groove portion 18M on the inner peripheral side. The groove portion 18M places a central axis CL2 of the gasket 18 as the center. As a result, the inner peripheral portion of the gasket 18 projects toward the inner peripheral side across the whole circumference. Accordingly, an inner diameter K of the gasket 18 is smaller than the thread size of the thread portion 15.

Figure 3:
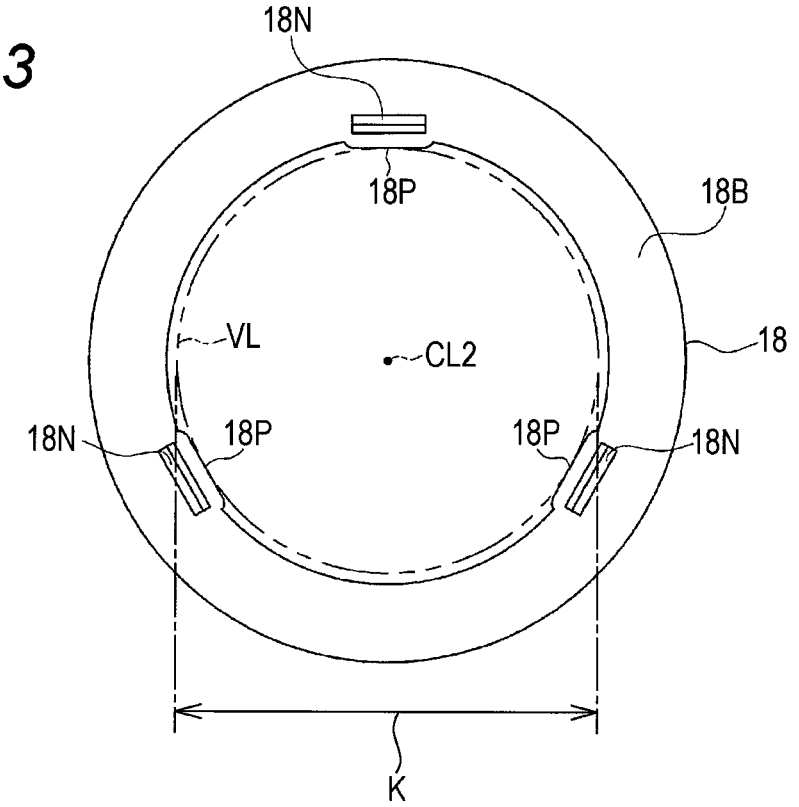
FIG. 3 is an enlarged bottom view showing another exemplary gasket.

The inner peripheral portion of the gasket 18 needs not to project toward the inner peripheral side across the whole circumference. The inner peripheral portion of the gasket 18 may only partially project toward the inner peripheral side. Therefore, for example, as shown in FIG. 3, a plurality of groove portions 18N may be intermittently disposed on the inner peripheral side of the tip end side face 18B along the circumferential direction. In this case, a plurality of protrusions 18P, which projects toward the inner peripheral side of the gasket 18, is intermittently disposed along the circumferential direction. In this case, the inner diameter K of the gasket 18 is equivalent to a diameter of a hypothetical circle VL in contact with each protrusion 18P. The diameter becomes smaller than the thread size of the thread portion 15.

Referring again to FIG. 1, the metal shell 3 includes, near the rear end side thereof, a tool engagement portion 19 having a hexagonal cross section. The tool engagement portion 19 allows a tool, such as a wrench, to be engaged when the spark plug 1 is mounted in the combustion apparatus. The metal shell 3 includes a caulking portion 20 provided at a rear end side with respect to the tool engagement portion 19. The caulking portion 20 is bent toward radially inward.

A tapered shoulder portion 21 is formed at the inner periphery of the metal shell 3 to allow the insulator 2 to be seated on. The insulator 2 is inserted to the tip end side into the metal shell 3 from the rear end side of the metal shell 3. In a state where the shoulder portion 14 of the insulator 2 is seated on the shoulder portion 21 of the metal shell 3, a rear-end opening portion of the metal shell 3 is caulked radially inward; that is, the caulking portion 20 is formed, whereby the insulator 2 is secured to the metal shell 3. An annular sheet packing 22 is interposed between the shoulder portion 14 and the shoulder portion 21. The sheet packing 22 retains air tightness in a combustion chamber. The sheet packing 22 reduces or prevents outward leakage of fuel gas which enters the clearance between the inner peripheral surface of the metal shell 3 and the insulator nose length portion 13 of the insulator 2, which is exposed to the combustion chamber.

Further, in order to further ensure sealing which is established by caulking, annular ring members 23 and 24 are interposed between the metal shell 3 and the insulator 2 at the rear end side of the metal shell 3. Powder of talc 25 is filled up between the ring members 23 and 24. That is, the metal shell 3 holds the insulator 2 via the sheet packing 22, the ring members 23 and 24, and the tale 25.

A ground electrode 27 is sealed to a tip end portion 26 of the metal shell 3. The ground electrode 27 is bent at an approximately central portion thereof. Accordingly, the side face on the tip end side of the ground electrode 27 faces a tip end portion of the center electrode 5 (the tip 31). The ground electrode 27 includes an outer layer 27A formed of an alloy which contains Ni as a main constituent and an inner layer 27B formed of metal excellent in thermal conductivity (for example, copper, copper alloy, and pure Ni). A spark discharge gap 33 is formed between the tip end face of the center electrode 5 (the tip 31) and the tip end portion (the other end portion) of the ground electrode 27. Sparks are discharged at the spark discharge gap 33 in the direction almost along the axis CL1.

Figure 4:
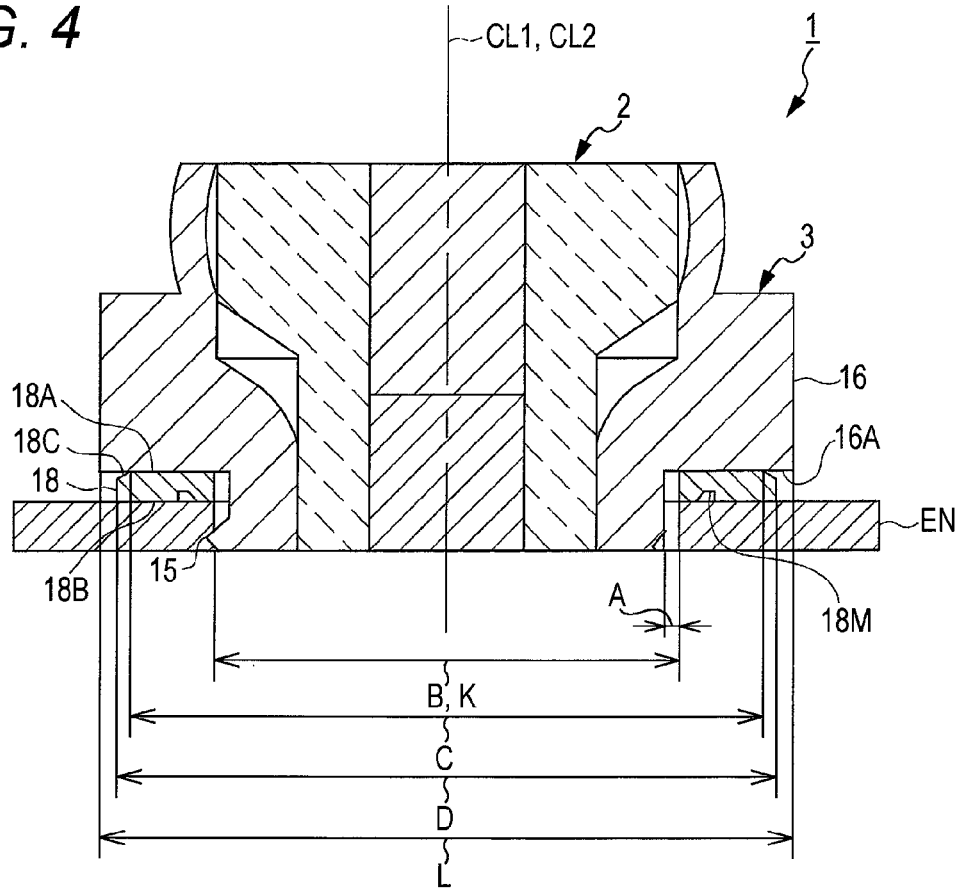
FIG. 4 is an enlarged sectional view showing a configuration of a gasket and other associated components.

Next, the configuration of the gasket 18, which is a characteristic part of this disclosure, will be described. As shown in FIG. 4, a chamfering portion 18C is formed between the rear end side face 18A of the gasket 18 and the outer peripheral face of the gasket 18. The chamfering portion 18C has an outer diameter gradually increasing toward the tip end side. Accordingly, the outer diameter C (mm) of the rear end side face 18A of the gasket 18 in contact with the seating portion 16A when the spark plug 1 is mounted in a combustion apparatus EN becomes comparatively small.

Here, as shown in FIG. 4, the outer diameter of the seating portion 16A is assumed as L (mm). The maximum shift distance (the maximum value) of the gasket 18 in contact with the seating portion 16A is assumed as A (mm). The gasket 18 is shiftable relative to the metal shell 3 along a direction orthogonal to the axis CL1, from a position where the axis CL1 and the central axis CL2 of the gasket 18 coincide. The maximum value A is a maximum value of the relative shift of the gasket 18. The spark plug 1 (or the gasket 18) is configured so as to satisfy $C \leq L-2A$.

Figure 5:
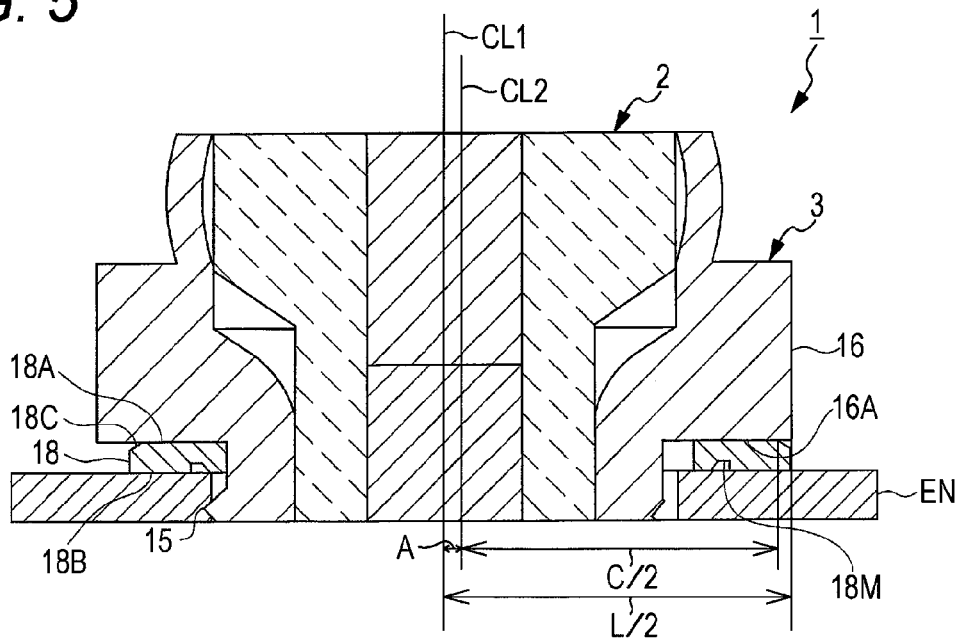
FIG. 5 is an enlarged sectional view showing the gasket and other associated components in a state where the gasket is most-shifted along a direction orthogonal to an axis.

That is, the maximum value A corresponds to the maximum distance where the gasket 18 with the axis CL1 and the central axis CL2 coinciding is shiftable to the direction orthogonal to the axis CL1. As shown in FIG. 5, the spark plug 1 (or the gasket 18) is configured so as to satisfy $L/2 \leq C/2+A$ when the gasket 18 is most-shifted along the direction orthogonal to the axis CL1. In view of this, the rear end side face 18A of the gasket 18 is always positioned on the inner peripheral side with respect to the outermost peripheral portion of the seating portion 16A.

Generally, the larger the outer diameter L of the seating portion 16A, the larger the tightening torque becomes when the spark plug 1 is mounted in the combustion apparatus EN. Accordingly, the force applied from the seating portion 16A to the rear end side face 18A along the axis CL1 direction also becomes larger. Considering this respect, in this embodiment, the spark plug 1 (or the gasket 18) is configured to satisfy $0.8L \leq C$ as shown in FIG. 4. When the inner diameter of the rear end side face 18A is assumed as B (mm), the spark plug 1 (or the gasket 18) is configured so as to satisfy $B \leq 0.75L$. That is, the spark plug 1 (or the gasket 18) is configured such that the area of the rear end side face 18A becomes a sufficient size according to the amount of the tightening torque (a force applied from the seating portion 16A to the rear end side face 18A). This reduces or prevents excessive increase of a pressure applied to the rear end side face 18A along the axis CL1 direction when the spark plug 1 is mounted in the combustion apparatus EN.

An outer diameter D (mm) of the tip end side face 18B of the gasket 18 in contact with the combustion apparatus EN when the spark plug 1 is mounted in the combustion apparatus EN is designed larger than the outer diameter C (mm) of the rear end side face 18A.

As details are described above, according to this embodiment, the spark plug 1 (or the gasket 18) is configured to satisfy $C \leq L-2A$. This reduces or prevents fluctuation in the contact area of the rear end side face 18A of the gasket 18 and the seating portion 16A due to the shift of the gasket 18. In view of this, the contact area of the rear end side face 18A of the gasket 18 and the seating portion 16A can be constant. This ensures a constant frictional contact resistance generated between the rear end side face 18A and the seating portion 16A when the spark plug 1 is mounted in the combustion apparatus EN. As a result, when the spark plug 1 is mounted in the combustion apparatus EN, the ground electrode 27 can be accurately disposed in a predetermined position.

In this embodiment, the spark plug 1 (or the gasket 18) is configured to satisfy $0.8L \leq C$ and $B \leq 0.75L$. In view of this, the area of the rear end side face 18A is sufficiently ensured corresponding to the size of the outer diameter C of the seating portion 16A (that is, an amount of a force applied from the seating portion 16A to the rear end side face 18A). Therefore, when the spark plug 1 is mounted in the combustion apparatus EN, pressure applied to the rear end side face 18A can be reduced or prevented from becoming excessively large. Accordingly, the rear end side face 18A can be further reliably reduced or prevented from being excessively collapsed and deformed. Consequently, a variation in the turning angle of the spark plug 1 can be further reliably reduced or prevented when the spark plug 1 is mounted in the combustion apparatus EN. As a result, the ground electrode can be further accurately disposed in a predetermined position.

The outer diameter D of the tip end side face 18B is designed larger than the outer diameter C of the rear end side face 18A. In view of this, the contact area of the tip end side face 18B and the combustion apparatus EN can be sufficiently ensured. As a result, good air tightness can be achieved.

The outer diameter D is designed sufficiently large. This allows reducing the sliding of the gasket 18 with respect to the combustion apparatus EN when the spark plug 1 is mounted in the combustion apparatus EN. This can efficiency reduce generating metal powder such as aluminum powder from the combustion apparatus EN in accordance with the sliding of the gasket 18. Accordingly, stability of a frictional state can be ensured between the tip end side face 18B and the combustion apparatus EN. In view of this, the ground electrode 27 can be further accurately disposed in a predetermined position.

The smaller the thread size of the thread portion 15 is, the smaller the tightening torque becomes when the spark plug 1 is mounted in the combustion apparatus EN. In the case where the tightening torque is thus small, change in the area of contact between the seating portion 16A and the rear end side face 18A (change in frictional contact resistance arising between the two) when the spark plug 1 is mounted in the combustion apparatus EN has a greater impact on the determination of the location where the ground electrode 27 is finally disposed. In this embodiment, the thread size of the thread portion 15 is set equal to or less than M12 or equal to or less than M10. Accordingly, even a slight change in the area of contact between the seating portion 16A and the rear end side face 18A risks greatly varying the position where the ground electrode 27 is finally disposed.

However, in this embodiment, the spark plug 1 (or the gasket 18) is configured so that the contact area of the seating portion 16A and the rear end side face 18A is constant. In view of this, even if the thread size of the thread portion 15 is M12 or equal to or less than M10, the ground electrode 27 can be accurately disposed in a predetermined position. In other words, the configuration of this embodiment is especially effective when the thread size of the thread portion 15 is M12 or equal to or less than M10.

Next, a test for confirming the operational advantages achieved by the above-described embodiment will be described. Respective sets of thirty samples of the spark plugs where the thread sizes of the thread portions were M10, M12, and M14 and the outer diameters C (mm) of the rear end side faces of the gaskets were variously changed were manufactured. A positioning-accuracy check test was performed on each sample.

The overview of the positioning-accuracy check test is as follows. That is, each sample was mounted in an aluminum bush for the test, which imitates an engine head of an internal combustion engine, with a predetermined tightening torque set to each thread size. Then, the turning angle of the ground electrode with respect to the preliminarily-set reference position of each sample was measured. The standard deviation a of the turning angle of each sample (30 samples) was multiplied by 4 (4σ). A small 4σ means a small variation in the arranged position of the ground electrode, that is, the ground electrode can be further accurately disposed in a predetermined position. A rate of improvement in 4σ of the sample satisfying C≤L−2A to 4σ of the sample satisfying C>L−2A was calculated. In calculating the rate of improvement, 4σ of the sample satisfying C>L−2A was assumed as s1. 4σ of the sample satisfying C≤L−2A was assumed as s2. The rate of improvement is calculated by (s1−s2)/s1. A large rate of improvement means that the operational advantages by satisfying C≤L−2A is considerable.

Samples of the spark plugs where the thread sizes of the thread portions were M10, M12, or M14 and the outer diameters C (mm) and the inner diameter B (mm) were variously changed were manufactured. An air tightness evaluation test was performed on these samples. The overview of the air tightness evaluation test is as follows. That is, each sample was mounted in the aluminum bush with a predetermined tightening torque set to each thread size. Then, air pressure of 1.5 MPa was applied to the tip end portion of each sample. A leakage amount of air from between: the gasket, and the metal shell and the aluminum bush were measured. Here, the sample with the leakage amount of less than 1 cc/min was regarded as excellent in air tightness and evaluated as "o". Meanwhile, the sample with the leakage amount of equal to or more than 1 mm/min was regarded to be inferior in air tightness and evaluated as "x".

Table 1 shows the test results of the positioning-accuracy check test and the air tightness evaluation test.

In both tests, the samples with the thread size of M10 were set so that the outer diameters L of the seating portions were set to 15.6 mm, the outer diameters of the thread root portions were set to 9.0 mm, the inner diameters of the gaskets (in this test, the inner diameters were equal to the inner diameters B of the rear end side faces) were set to 10.5 mm, and the maximum values A were set to 0.75 (=(10.5−9.0)/2) mm. Therefore, in the samples with the thread size of M10, L−2A was 14.1 mm, 0.8L was 12.5 mm, and 0.75L was 11.7 mm.

The samples with the thread size of M12 were set so that the outer diameters L of the seating portions were set to 16.7 mm, the outer diameters of the thread root portions were set to 10.8 mm, the inner diameters of the gaskets (the inner diameters B of the rear end side faces) were set to 11.9 mm, and the maximum values A were set to 0.55 (=(11.9-10.8)/2) mm. Therefore, in the samples with the thread size of M12, L−2A was 15.6 mm, 0.8L was 13.4 mm, and 0.75L was 12.5 mm.

The samples with the thread size of M14 were set so that the outer diameters L of the seating portions were set to 19.0 mm, the outer diameters of the thread root portions were set to 12.8 mm, the inner diameters of the gaskets (the inner diameters B of the rear end side faces) were set to 13.9 mm, and the maximum values A were set to 0.55 (=(13.9-12.8)/2) mm. Therefore, in the samples with the thread size of M14, L−2A was 17.9 mm, 0.8L was 15.2 mm, and 0.75L was 14.3 mm.

The samples with the thread size of M10 were mounted to the aluminum bushes with the tightening torque of 12N·m. The tightening torque of the samples with the thread size of M12 was 20N·m. The tightening torque of the samples with the thread size of M14 was 30N·m.

TABLE 1

| Sample No. | Thread size | L-2A (mm) | 0.8 L (mm) | 0.75 L (mm) | Outer diameter C (mm) | Inner diameter B (mm) | 4σ (°) | Rate of improvement (%) | Air tightness evaluation |
|---|---|---|---|---|---|---|---|---|---|
| 1 | M10 | 14.1 | 12.5 | 11.7 | 14.2 | 10.5 | 20 | — | ○ |
| 2 | | | | | 14.1 | | 18 | 10 | ○ |
| 3 | | | | | 13 | | 18 | 10 | ○ |
| 4 | | | | | 12.5 | | 18 | 10 | ○ |
| 5 | | | | | 12.4 | | 19 | 5 | x |
| 6 | | | | | 12.5 | 11.7 | 18 | 10 | ○ |
| 7 | | | | | 13 | 11.6 | 18 | 10 | ○ |
| 8 | | | | | | 11.7 | 18 | 10 | ○ |
| 9 | | | | | | 11.8 | 19 | 5 | x |
| 11 | M12 | 15.6 | 13.4 | 12.5 | 16.7 | 11.9 | 21 | — | ○ |
| 12 | | | | | 15.7 | | 21 | — | ○ |
| 13 | | | | | 15.6 | | 19 | 9.5 | ○ |
| 14 | | | | | 14 | | 19 | 9.5 | ○ |
| 15 | | | | | 13.4 | | 19 | 9.5 | ○ |
| 16 | | | | | 13.3 | | 20 | 4.8 | x |
| 17 | | | | | 13.4 | 12.5 | 19 | 9.5 | ○ |
| 18 | | | | | 14 | 12.4 | 19 | 9.5 | ○ |
| 19 | | | | | | 12.5 | 19 | 9.5 | ○ |
| 20 | | | | | | 12.6 | 20 | 4.8 | x |
| 21 | M14 | 17.9 | 15.2 | 14.3 | 19.2 | 13.9 | 23 | — | ○ |
| 22 | | | | | 18 | | 23 | — | ○ |
| 23 | | | | | 17.9 | | 21 | 8.7 | ○ |
| 24 | | | | | 16 | | 21 | 8.7 | ○ |
| 25 | | | | | 15.2 | | 21 | 8.7 | ○ |
| 26 | | | | | 15.1 | | 22 | 4.3 | x |
| 27 | | | | | 15.2 | 14.3 | 21 | 8.7 | ○ |
| 28 | | | | | 16 | 14.2 | 21 | 8.7 | ○ |
| 29 | | | | | | 14.3 | 21 | 8.7 | ○ |
| 30 | | | | | | 14.4 | 22 | 4.3 | x |

Comparing samples with the same thread size with each other, as shown in Table 1, with the samples satisfying 0.8L≤C≤L−2A and B≤0.75 L (samples 2 to 4, 6 to 8, 13 to 15, 17 to 19, 23 to 25, and 27 to 29) had a small 4σ. This comparison found that these samples were less likely to vary in the turning angle (arranged position) of the ground electrode. This is probably because of the following (1) and (2).

(1) Satisfying C≤L−2A kept the contact area of the rear end side face of the gasket and the seating portion constant in mounting. As a result, a frictional contact resistance generated between the gasket and the seating portion was kept constant.

(2) Satisfying 0.8L≤C and B≤0.75L sufficiently ensured the area of the rear end side face of the gasket. As a result, excessive collapse and deformation of the rear end side face of the gasket in mounting was restricted.

It was confirmed that the samples satisfying 0.8L≤C and B≤0.75L (samples 1 to 4, 6 to 8, 11 to 15, 17 to 19, 21 to 25, and 27 to 29) had good air tightness. This is probably because that the contact area of the rear end side face of the gasket and the seating portion was sufficiently ensured.

As apparent from Table 1, compared to the rate of improvement of the samples with the thread size of the thread portion of M14, the rate of improvement of the samples with the thread size of the thread portion of M12 was larger, and the rate of improvement of the samples with the thread size of the thread portion of M10 was further larger. That is, it was found that the smaller the thread size of the thread portion was, the more significant the operational advantages achieved by satisfying C≤L−2A.

According to the test results, satisfying 0.8L≤C≤L−2A and B≤0.75L are preferred from a perspective of ensuring good air tightness while the ground electrode is accurately locatable in a predetermined position when the spark plug is mounted in the internal combustion engine or similar.

Satisfying 0.8 L≤C≤L−2A and B≤0.75L is specifically meaningful for the spark plug with the thread size of the thread portion of equal to or less than M12 where the arranged position of the ground electrode is prone to vary. Satisfying 0.8L≤C≤L−2A and B≤0.75L is extremely meaningful for the spark plug with the thread size of the thread portion of equal to or less than M10 where the arranged position of the ground electrode is further prone to vary.

Note that the technique according to the disclosure is not limited to the description of the embodiment. The technique according to the disclosure may be, for example, implemented as follows. Of course, the technique according to the disclosure is also possible to be implemented as other applications and alterations, not exemplified below.

Figure 6:
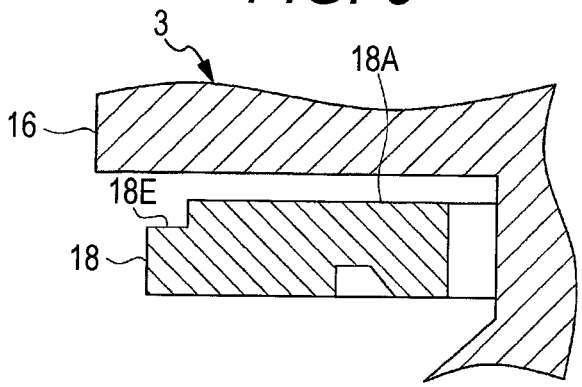
FIG. 6 is an enlarged partial sectional view showing a configuration of a gasket according to another embodiment.
Figure 7:
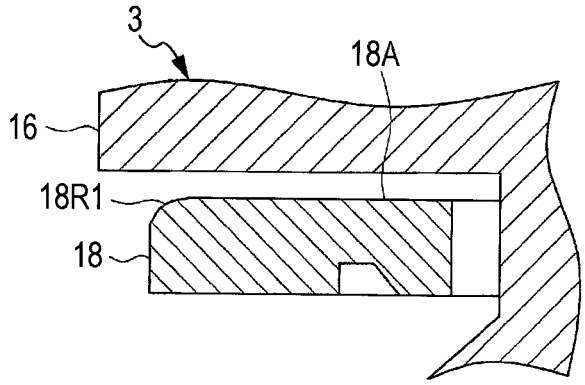
FIG. 7 is an enlarged partial sectional view showing a configuration of a gasket according to another embodiment.
Figure 8:
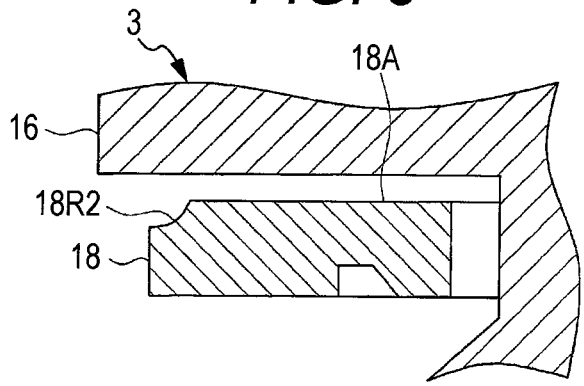
FIG. 8 is an enlarged partial sectional view showing a configuration of a gasket according to another embodiment.
Figure 9:
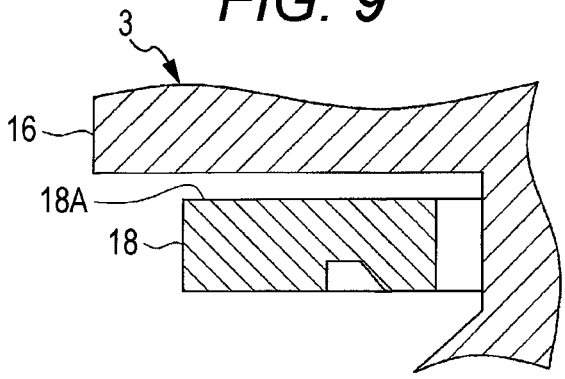
FIG. 9 is an enlarged partial sectional view showing a configuration of a gasket according to another embodiment.
Figure 10:
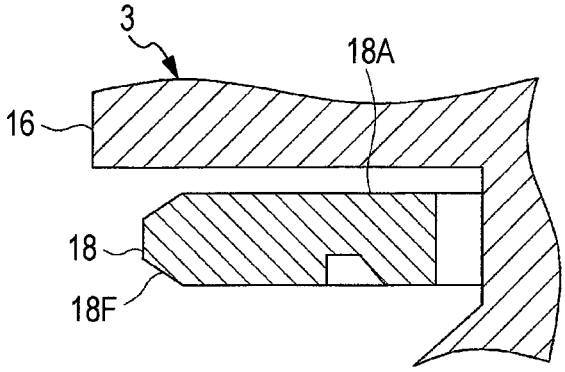
FIG. 10 is an enlarged partial sectional view showing a configuration of a gasket according to another embodiment.
Figure 11:
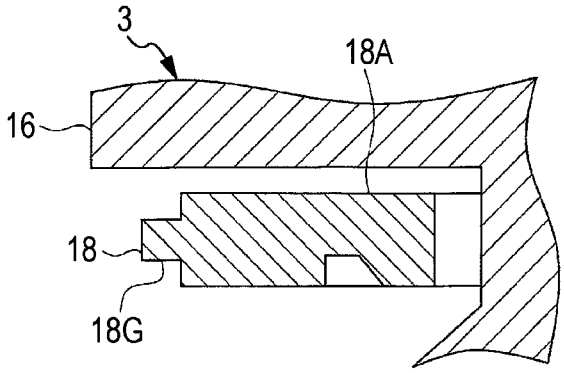
FIG. 11 is an enlarged partial sectional view showing a configuration of a gasket according to another embodiment.
Figure 12:
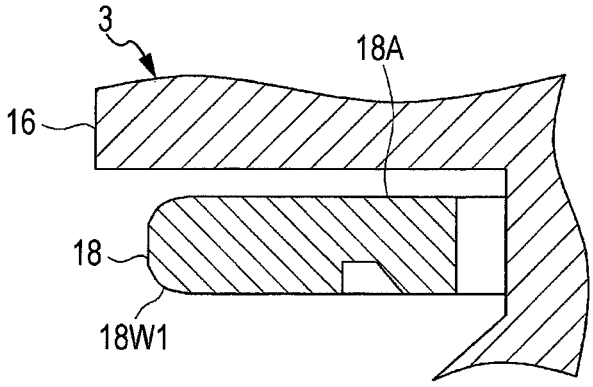
FIG. 12 is an enlarged partial sectional view showing a configuration of a gasket according to another embodiment.
Figure 13:
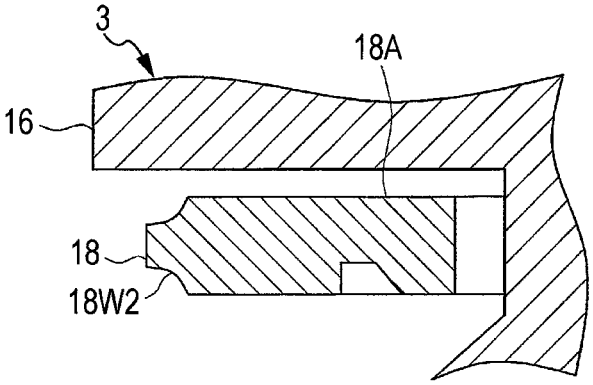
FIG. 13 is an enlarged partial sectional view showing a configuration of a gasket according to another embodiment.

(a) In the embodiment, the chamfering portion 18C is formed at the gasket 18. This makes the outer diameter C (mm) of the rear end side face 18A comparatively small. Consequently, C≤L−2A is easily satisfied. In contrast to this, for example, as shown in FIG. 6, a depressed portion 18E may be disposed at the outer peripheral portion on the rear end side of the gasket 18. As shown in FIG. 7 and FIG. 8, a curved portion 18R1 or 18R2 may be disposed at the outer peripheral portion on the rear end side of the gasket 18. The curved portion 18R1 or 18R2 projects to the outside or the inside. This makes the outer diameter C comparatively small. As a result, C≤L−2A is easily satisfied. To satisfy C≤L−2A, the chamfering portion 18C, the depressed portion 18E, or similar member needs not to be disposed. As shown in FIG. 9, the face of the gasket 18 on the seat portion 16 side may be flat.

(b) In the embodiment, the face at the outer periphery portion of the gasket 18 on the opposite side from the seat portion 16 is flat. This should not be construed in a limiting sense. As shown in FIG. 10 to FIG. 13, a chamfering portion 18F, a depressed portion 18G, a curved portion 18W1 or 18W2, or similar member may be disposed at the outer periphery portion.

(c) In the embodiment, a groove portion 18M is disposed on the inner peripheral side of the gasket 18. This should not be construed in a limiting sense. The tip end side face 18B of the gasket 18 may be flat without disposing the groove portion 18M.

(d) In the embodiment, the ground electrode 27 is sealed to the tip end portion 26 of the metal shell 3. This should not be construed in a limiting sense. The ground electrode may be formed by cutting a part of the metal shell (or a part of a metal tip end welded to the metal shell in advance) (See Japanese Patent Application Laid-Open (kokai) No. 2006-236906, for example). The technique of this disclosure is applicable to such configuration.

(e) In the embodiment, the cross section of the tool engagement portion 19 has a hexagonal shape. However, the shape of the tool engagement portion 19 is not limited to this shape. For example, the shape of the tool engagement portion 19 may be a Bi-HEX (modified dodecagon) shape (ISO22977: 2005(E)).

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A spark plug comprising:

a tubular metal shell extending along an axis; and a solid annular gasket disposed at an outer periphery of the metal shell, wherein the metal shell includes:

a thread portion formed at an outer periphery on a tip end side of the metal shell;

a seat portion formed on a rear end side with respect to the thread portion, the seat portion bulging radially outward; and a thread root portion disposed between the thread portion and the seat portion, wherein the gasket has an inner diameter smaller than a thread size of the thread portion, the gasket being disposed at an outer periphery of the thread root portion, and 0.8L≤C≤L−2A and B≤0.75L are satisfied in a case where:

in the seat portion, an outer diameter of a seating portion that is a surface positioned at the gasket side is L (mm);

when the gasket contacts the seating portion, a maximum value of a relatively shiftable distance is A (mm), the gasket being shiftable along a direction orthogonal to the axis relative to the metal shell by the maximum value from a state where the axis and a central axis of the gasket coincide with each other;

in the gasket, an outer diameter of a face in contact with the seating portion is C (mm); and in the gasket, an inner diameter of a face in contact with the seating portion is B (mm).

2. The spark plug according to claim 1, wherein in the gasket, an outer diameter of a face at an opposite side from the seating portion is larger than an outer diameter of a face of the gasket in contact with the seating portion.

3. The spark plug according to claim 1, wherein the thread portion has a thread size equal to or less than M12.

4. The spark plug according to claim 1, wherein the thread portion has a thread size equal to or less than M10.

5. The spark plug according to claim 2, wherein the thread portion has a thread size equal to or less than M12.

6. The spark plug according to claim 2, wherein the thread portion has a thread size equal to or less than M10.

* * * * *